US006698620B2

(12) United States Patent
Ogata et al.

(10) Patent No.: US 6,698,620 B2
(45) Date of Patent: Mar. 2, 2004

(54) AEROSOL VALVE FOR HIGH RATE FILLING

(75) Inventors: Ken Ogata, Saitama-ken (JP); Shinobu Watanabe, Kawagoe (JP)

(73) Assignee: Toyo Aerosol Industry Co., Ltd., Tokyo (JP)

( * ) Notice: Subject to any disclaimer, the term of this patent is extended or adjusted under 35 U.S.C. 154(b) by 0 days.

(21) Appl. No.: 10/071,171

(22) Filed: Feb. 8, 2002

(65) Prior Publication Data

US 2002/0179736 A1 Dec. 5, 2002

(30) Foreign Application Priority Data

May 30, 2001 (JP) ..... 2001-162196

(51) Int. Cl.[7] ..... B65D 35/28
(52) U.S. Cl. ..... 222/95; 222/402.16; 141/20
(58) Field of Search ..... 222/95, 105, 386.5, 222/402.16; 141/3, 20

(56) References Cited

U.S. PATENT DOCUMENTS 3,651,997 A * 3/1972 Venus, Jr. ..... 222/402.16
3,869,072 A * 3/1975 Eyerdam et al. ..... 222/402.16
4,015,752 A * 4/1977 Meuresch et al. ..... 222/402.16
4,216,884 A * 8/1980 Giuffredi ..... 222/402.16
5,119,970 A 6/1992 Arieh et al. ..... 222/1
5,211,316 A * 5/1993 Adalberto et al. ..... 222/386.5
6,070,770 A * 6/2000 Tada et al. ..... 222/635

FOREIGN PATENT DOCUMENTS

| | | |
|---|---|---|
| EP | 0 718 213 | 6/1996 |
| JP | 8-143078 | 6/1996 |
| JP | 8-169483 | 7/1996 |
| JP | 9-310774 | 12/1997 |
| JP | 2000-161516 | 6/2000 |
| JP | 2001-293401 | 10/2001 |
| JP | 2001-300365 | 10/2001 |
| WO | WO 00/581154 | 10/2000 |

* cited by examiner

*Primary Examiner*—Joseph A. Kaufman
(74) *Attorney, Agent, or Firm*—Jordan and Hamburg LLP

(57) ABSTRACT

An aerosol valve for high rate filling including an upper chamber and a lower chamber formed inside a housing. A stem is attached to the upper chamber in a vertically movable manner and a switching valve is attached to the lower chamber in a vertically movable manner. A narrow flow port is arranged in the switching valve to provide flow communication between the upper chamber and the lower chamber. The switching valve is pressed and urged against a valve seat of the flow port to close the flow port except for the communication of the narrow flow port, and the switching valve is pressed by filling pressure to open the flow port during a filling procedure of the content via the stem to thereby enable the content to be filled rapidly.

16 Claims, 5 Drawing Sheets

AEROSOL VALVE FOR HIGH RATE FILLING

BACKGROUND OF THE INVENTION

1. Field of the Invention

This invention relates to an aerosol container for spraying content such as: hair products, e.g., hair colorants, cosmetics, deodorants, antiperspirants and other human targeted products; insect repellants, coating agents, cleaners and other household products; industrial products; and automobile related products; in which the aerosol container enables the content to be filled at a high rate. More particularly, this invention is effective when used as a valve for an aerosol container with an internal bag arranged therein.

2. Description of Related Art

Conventionally, as shown in FIG. 5, a double-layer aerosol container exists, in which the aerosol container has an internal bag inserted inside an outer container for filling the content and has a lower end of a housing of a valve mechanism inserted at a top end opening of the internal bag. A push button or the like with a content spraying nozzle is connected to a top end portion of a stem protruding outward from the housing for spraying the content. In order to fill the content into the internal bag of the double-layer aerosol container, a suitable filling device (not shown) is connected to the top end portion of the stem protruding from the housing. When the pressing pressure upon the stem depresses the stem toward the internal bag, the orifice closed by a stem gasket becomes open to open the valve mechanism. After the content has flowed into the housing from the filling device to the discharge channel and the orifice inside the stem, the content is filled inside the internal bag. After the completion of the filling procedure and releasing of the depressed stem, the position of the stem would return to the initial position, the valve mechanism would close, and the content of the internal bag would be isolated from the exterior.

Further, also with an aerosol container using no internal bag, a filling device is connected to a top end portion of a stem for filling the content inside the aerosol container via the stem.

Nevertheless, with the conventional method of filling the content via a narrow discharge channel and a diametrally small orifice arranged inside the stem, the filling procedure is time consuming and inefficient in terms of productivity. Further, the filling from the stem takes excessive time especially when the content has a high viscosity. If the discharge channel and the orifice of the stem are formed with large diameters in a means to solve the foregoing problem, the content could be filled rapidly during the filling procedure. However, when the content is sprayed after the filling procedure with use of such stem, an excessive amount of the content externally emerges through the orifice, the discharge channel, and the nozzle or the like in just a short time, a diametrally fine particle could not be formed, and an extremely undesirable result from the use of the aerosol container (such as dripping on the coating surface) could easily be anticipated due to the excessive amount of the discharged content.

It is an object of this invention to solve the aforementioned problems and increase the productivity of aerosol products by enabling the content to be filled into an aerosol container at a high rate. Further, this invention is structured to spray only a suitable amount of content during a spraying procedure using the aerosol container and to prevent an exceeding amount of the content from being sprayed excessively.

SUMMARY OF THE INVENTION

For solving the aforementioned problems, this invention relates to an aerosol valve for high rate filling for an aerosol container comprising: a housing having a top end fixed to a top end opening of the aerosol container; an upper chamber and a lower chamber, each being formed inside the housing via a flow port; a stem being attached to the upper chamber in a vertically movable manner via a stem gasket, the stem urging and projecting a top end outward from a lid member; a switching valve being attached to the lower chamber in a vertically movable manner, the switching valve not contacting to a lower end of the stem even during a spraying procedure of the content; a narrow flow port opened at the switching valve in communication between the upper chamber and the lower chamber; wherein the switching valve is pressed and urged to a valve seat of the flow port to close the flow port except for the communication of the narrow flow port; and wherein the switching valve is pressured by filling pressure to open the flow port during a filling procedure of the content via the stem for allowing the content to be filled rapidly.

Further, the aerosol container could have an internal bag inserted and arranged therein, and the housing could have a lower end inserted and fixed within a top end opening of the internal bag.

Further, the aerosol container could have no internal bag inserted therein, and the housing could have a top end directly fixed within a top end opening of the aerosol container.

Since this invention has the aforementioned structure, the content flows into the upper chamber of the housing via the discharge channel and the orifice of the stem when the stem of the aerosol container is connected with a filling device and depressed with high pressure for filling the content. The content flowed inside pushes against the urging force of the switching valve arranged at the lower chamber with a valve seat thereof in close contact to the flow port, depresses the switching valve with filling pressure, and opens the flow port.

In association with the opening of the flow port, the filled content is quickly filled into the internal bag via the stem. Further, with this invention, the discharge channel and the orifice can be formed at the stem, wherein the discharge chamber and the orifice have a diameter capable enough for flowing the content in matching the filling amount of the opened flow port. That is, when the filling of the content is completed, the stem returns to an initial position thereof, and the stem gasket closes the orifice since the stem is not subject to pressure from the filling device. The switching valve also returns to an initial position thereof and the valve seat of the switching valve closely contacts to the flow port thereby closing the flow port.

Further, in a case where ordinary mist is sprayed using the aerosol container filled with the content, a push button of the stem is pressed for depressing the stem, so that the orifice of the stem separates from the stem gasket and becomes open. As explained above, although the discharge channel of the stem and the orifice are formed with a large diameter for filling the content rapidly, due to the fact that the switching valve is formed with the narrow flow port in communication between the upper chamber and the lower chamber, the narrow flow port would restrain the content having flowed from the inside of the aerosol container to the inside of the upper chamber of the housing so that the flow amount would be a suitable amount, by forming the narrow flow port small enough to allow the content to be suitably discharged. Accordingly, even if the discharge channel of the stem and the orifice are formed with large diameters, the content would not be sprayed excessively since only a suitable amount of the content is guided to the orifice and the stem via the upper chamber.

Owing to the foregoing structure of this invention, the content could be filled rapidly into the aerosol container during a filling procedure, thus being capable of restraining the flow amount and spraying only a suitable amount of the content from the nozzle or the like during discharge of the content.

BRIEF DESCRIPTION OF THE DRAWINGS

The above and other objects and features of the invention are apparent to those skilled in the art from the following preferred embodiments thereof when considered in conjunction with the accompanied drawings, in which.

DESCRIPTION OF THE PREFERRED EMBODIMENTS

Figure 1:
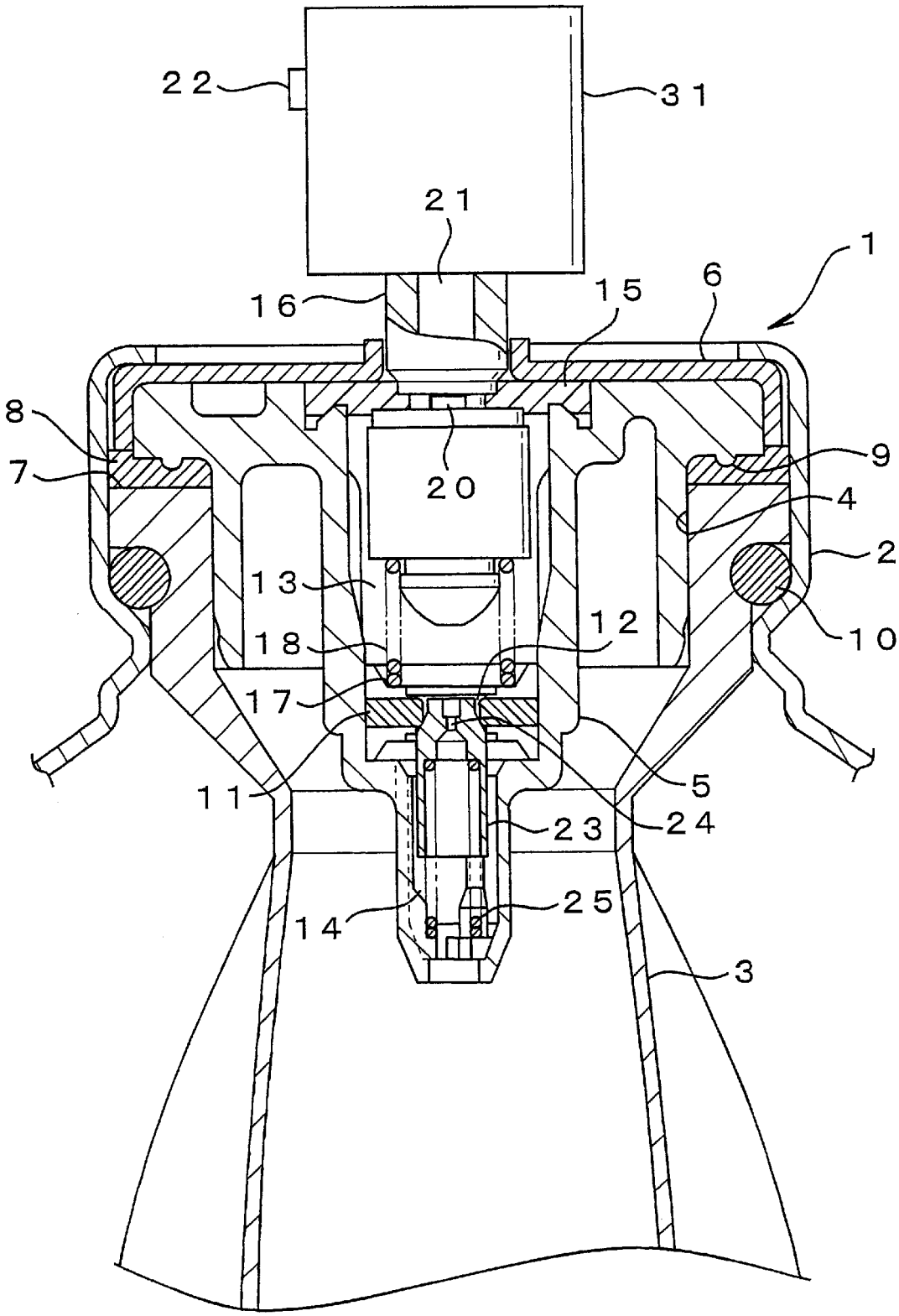
FIG. 1 is a cross sectional view showing an embodiment where an internal bag is in an attached state.

An embodiment regarding this invention will hereinafter be described with reference to FIG. 1, in which numeral 1 is an aerosol container comprising an outer container 2 formed from metal, hard plastic or the like, and an internal bag 3 formed from an easily transformable plastic or the like. A top end of a housing 5 is inserted and fixed inside of a top end opening 4 of the internal bag 3 being inserted inside the outer container 2. This housing 5 has a metal lid member 6 arranged on a top end surface of the housing 5, has a packing 8 arranged in-between with respect to a top end rim 7 of the internal bag 3, and engages an annular rib 9 disposed at a lower surface of the housing 5 with respect to an upper surface of the packing 8, for preventing the content from leaking from the inside of the internal bag 3. A seal gasket 10 is arranged between an outer periphery of the internal bag 3 and the outer container 2 so that a propellant pressuring the internal bag 3 from outside could be prevented from leaking.

Inside the housing 5, an upper chamber 13 and a lower chamber 14 are formed via a flow port 12 arranged at a separating wall 11. A stem 16 is attached to the upper chamber 13 through a stem gasket 15 to allow vertical movement of the stem 16 urging and projecting a top end thereof outward from the lid member 6. The stem 16 is pressingly urged upward by a pressing spring 18 arranged between a bottom base 17 of the upper chamber 13 and the stem 16, and in such urging state, an orifice 20 is hermetically sealed by the stem gasket 15. The orifice 20 and a discharge channel 21 of the stem 16 for discharging the content are formed with a size for allowing the content to be filled rapidly, and the most suitable amount for discharging the content from a nozzle 22 need not be taken into consideration.

In the lower chamber 14, a switching valve 23 is attached in a vertically movable manner at a position not contacting a bottom end portion of the stem 16, even when spraying the content. A narrow flow port 24 normally in communication between the upper chamber 13 and lower chamber 14 is opened at the switching valve 23, e.g., the narrow flow port 24 is a hole formed in the switching valve 23 as shown in FIGS. 1–4. The narrow flow port 24 is formed with a size allowing the content to be discharged in the most suitable amount, and serves to control the spraying amount and prevent excessive spraying from the nozzle 22. A spring 25 pressingly urges the switching valve 23 upon a valve seat of the flow port 12 so that the flow port 12 is normally closed (as shown in FIG. 1) except for the communication of the narrow flow port 24. As shown in FIGS. 1–4, the spring 25 has a lower end engaging the housing 5 and an upper end engaging with and arranged in an interior of the switching valve 23. During the filling of the content via the stem 16, the filling pressure of the content pressures the switching valve 23, and the flow port 24 opens to allow the content to be filled rapidly.

Figure 2:
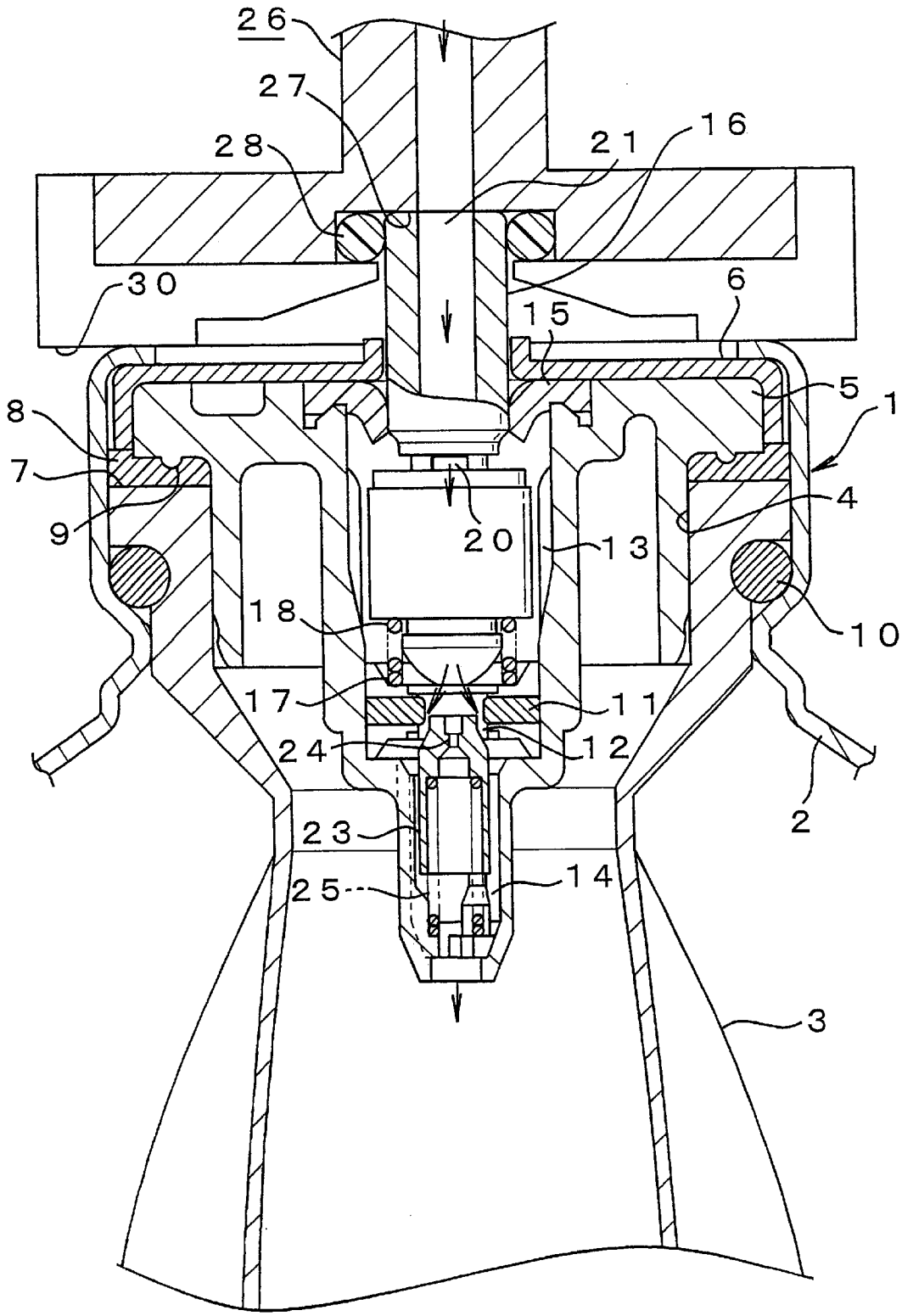
FIG. 2 is a cross sectional view showing a filling state of the content.

With this structure, the content is filled into the aerosol container 1 by connecting a filling nozzle 26 of a filling device to the stem 16, as shown in FIG. 2. The filling nozzle 26 has a protruding portion 27 protruding upon a top end of the stem 16, and an O-ring 28 closely contacting an outer periphery of the stem 16 at a lower surface of the protruding portion 27. A protruding portion 30 is arranged to project outward at a lower end of the filling nozzle 26 so that the stem 16 is depressed an optimal amount as the protruding portion 30 contacts the aerosol container 1.

As shown in FIG. 2, when the stem 16 is depressed with high pressure for filling the content using the filling nozzle 26, the content flows into the upper chamber 13 of the housing 5 via the discharge channel 21 and the orifice 20 of the stem 16. The content flowed inside pushes against the urging force of the switching valve 23 arranged at the lower chamber 14 with a valve seat thereof in close contact to the flow port 12, depresses the switching valve 23 with filling pressure, and opens the flow port 12.

In association with the opening of the flow port 12, the filled content is quickly filled into the internal bag 3 via the stem 16. Further, with this invention, the discharge channel 21 and the orifice 20 can be formed in the stem 16 with diameters capable for flowing the content in correspondence with the filling amount of the opened flow port 12. That is, when the filling of the content is completed, the stem 16 returns to an initial position thereof, and the stem gasket 15 closes the orifice 20 since the stem 16 is not subjected to pressure from the filling nozzle 26. The switching valve 23 also returns to an initial position thereof and the valve seat thereof closely contacts to the flow port 12, thereby closing the flow port 12.

Figure 3:
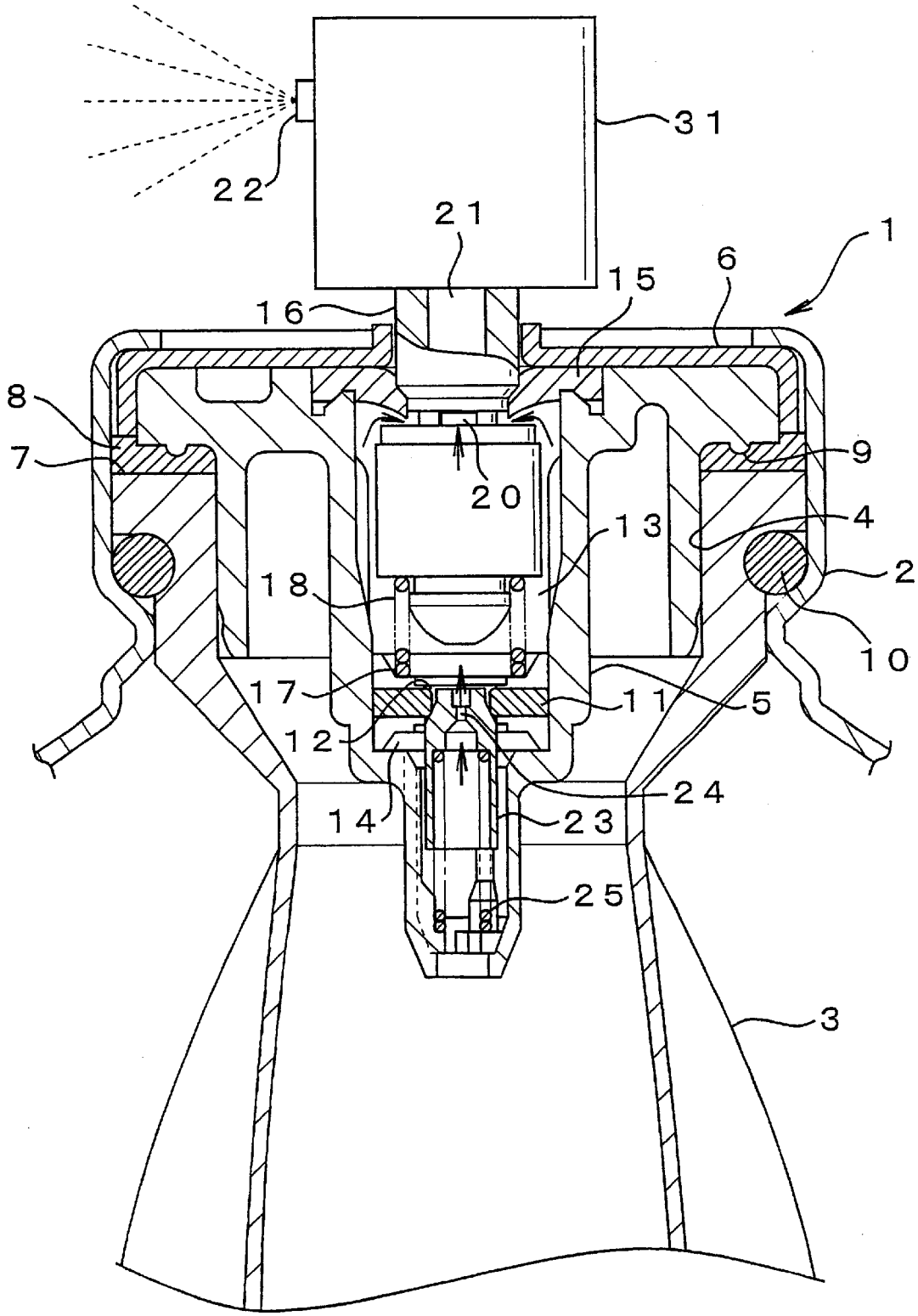
FIG. 3 is a cross sectional view showing a spraying state of the content.

As shown in FIG. 3, in a case where ordinary mist is sprayed using the aerosol container 1 filled with the content, a push button 31 of the stem 16 is pressed for depressing the stem 16, so that the orifice 20 of the stem 16 separates from the stem gasket 15 and becomes open. As explained above, although the discharge channel 21 and the orifice 20 of the stem 16 are formed with a large diameter for filling the content rapidly, due to the fact that the switching valve 23 is formed with the narrow flow port 24 normally in communication between the upper chamber 13 and the lower chamber 14, the narrow flow port 24 restrains the content having flowed from the inside of the aerosol container 1 through to the inside of the upper chamber 13 of the housing 5 to provide a suitable flow amount, by forming the narrow flow port 24 small enough for suitably discharging the content. Accordingly, even if the discharge channel 21 and the orifice 20 of the stem 16 are formed with large diameters, the content will not be sprayed excessively since only a suitable amount of the content is guided to the orifice 20 and the stem 16 via the upper chamber 13.

Figure 4:
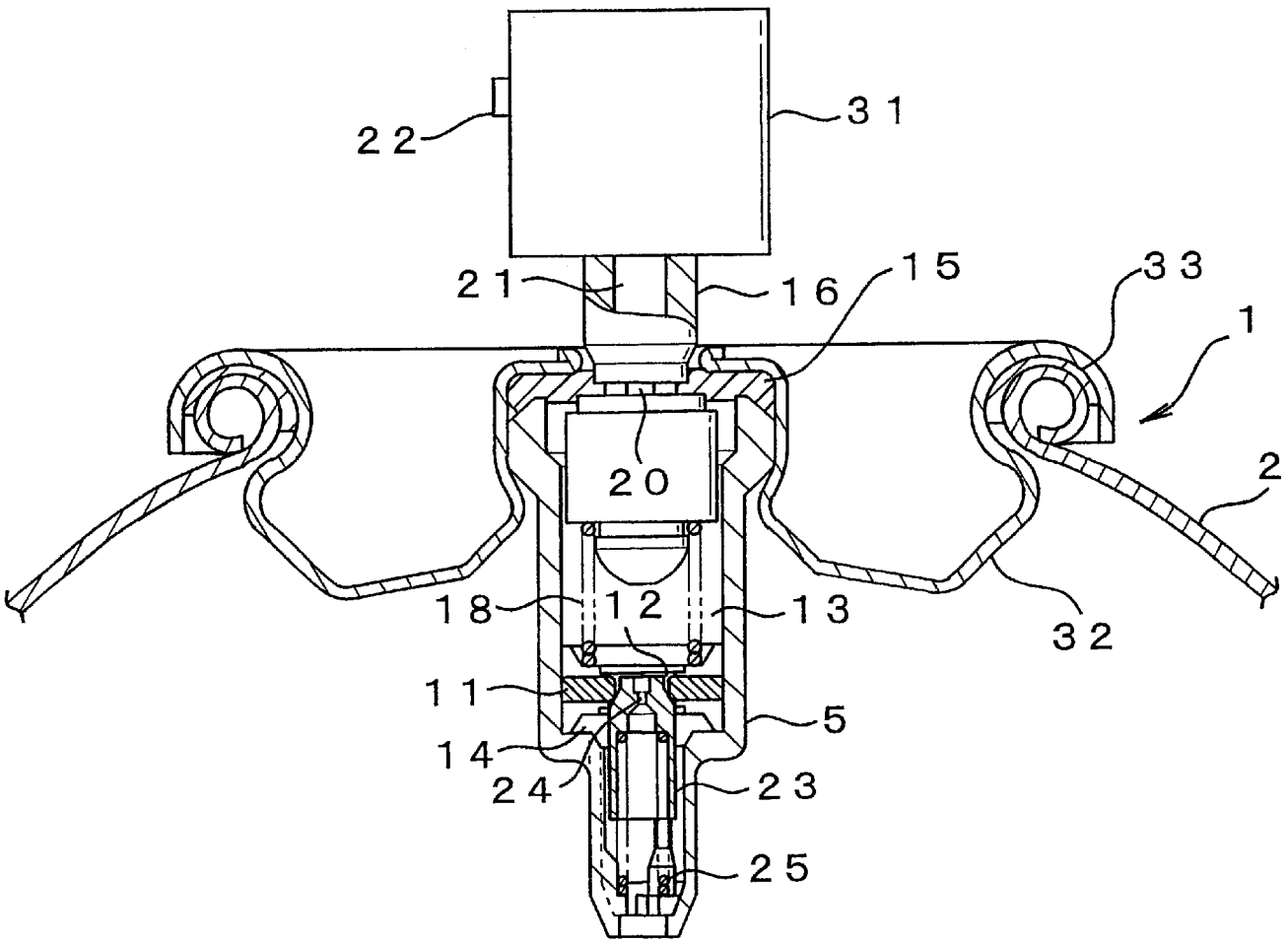
FIG. 4 is a cross sectional view showing a state where an internal bag is not used.
Figure 5:
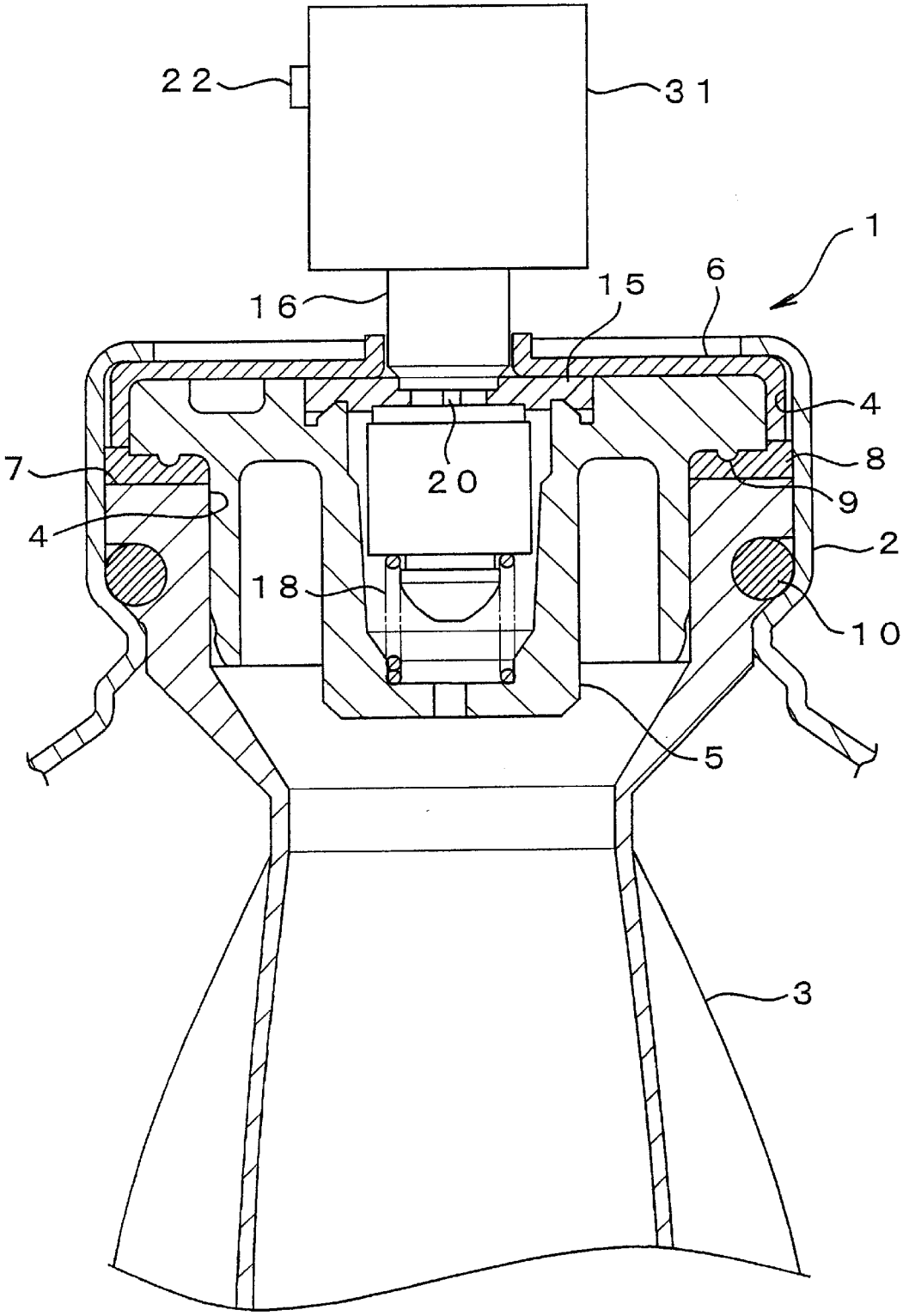
PRIOR ART FIG. 5
FIG. 5 is a cross sectional view showing a conventional publicly known art.

Further, although the foregoing embodiment is described using a double layer aerosol container with the internal bag 3 attached inside the aerosol container 1, other embodiments such as a typical aerosol container 1 having no internal bag 3 (as shown in FIG. 4) can also be used. In such a case, although structures except for the internal bag 3 may be the same as those of the foregoing embodiment, the embodiment shown in FIG. 4 uses a mountain cup 32 instead of using the lid member 6 and fixes the outer periphery of the mountain cup 32 with caulking via the gasket 33 at the top end of the aerosol container 1 so that the top end of the aerosol container 1 is hermetically sealed. Further, a top end of the housing 5 is fixed to a center portion of the mountain cup, and the stem gasket 15 maintains a sealed state of the housing 5. Further, neither the seal gasket 10, the packing 8 nor the like are used, since the internal bag is not used.

Since this invention has the foregoing structure, the content could be filled rapidly into the aerosol container during a filling procedure, thus being capable of restraining the flow amount and spraying only a suitable amount of the content from the nozzle or the like during discharge of the content.

The foregoing description of a preferred embodiment of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set forth below.

What is claimed is:

1. An aerosol valve for high rate filling for an aerosol container comprising:

a housing having a top end fixed to a top end opening of the aerosol container, said housing including an upper chamber and a lower chamber and a flow port providing flow communication between the upper chamber and the lower chamber, the flow port defining a valve seat;

a vertically movable stem arranged at least partially in the upper chamber, the stem urging and projecting a top end outward from a lid member;

a vertically movable switching valve arranged in the lower chamber, the switching valve not contacting a lower end of the stem, the switching valve including a narrow flow port arranged to provide flow communication between the upper chamber and the lower chamber; and pressing means for pressing and urging the switching valve against the valve seat of the flow port to close the flow port except for the communication of the narrow flow port, the switching valve being pressured by filling pressure to open the flow port during a filling procedure of the content via the stem for allowing the content to be filled rapidly into the container.

2. The aerosol valve for high rate filling according to claim 1, wherein the aerosol container has an internal bag inserted and arranged therein, and the housing has a lower end inserted and fixed within a top end opening of the internal bag.

3. The aerosol valve for high rate filling according to claim 1, wherein the aerosol container has no internal bag inserted therein, and the housing has a top end directly fixed within a top end opening of the aerosol container.

4. The aerosol valve for high rate filling according to claim 1, further comprising a separating wall arranged in the housing between the upper chamber and the lower chamber, the flow port being formed in the separating wall.

5. The aerosol valve for high rate filling according to claim 1, further comprising a stem gasket for attaching the stem to the upper chamber.

6. The aerosol valve for high rate filling according to claim 5, further comprising a spring arranged in the housing between a bottom of the upper chamber and the stem to bias the stem upward.

7. The aerosol valve for high rate filling according to claim 6, wherein the stem includes an orifice, the stem gasket being arranged to seal the orifice of the stem when the stem is pressed against the stem gasket by the spring.

8. The aerosol valve for high rate filling according to claim 1, further comprising a spring arranged in the housing between a bottom of the upper chamber and the stem to bias the stem upward.

9. The aerosol valve for high rate filling according to claim 1, wherein the switching valve does not contact the lower end of the stem even during a spraying procedure of the content.

10. The aerosol valve for high rate filling according to claim 1, wherein the pressing means comprise a spring.

11. The aerosol valve for high rate filling according to claim 10, wherein the spring has a first end engaging with the housing and a second end engaging with the switching valve.

12. The aerosol valve for high rate filling according to claim 11, wherein the second end of the spring is arranged inside of the switching valve.

13. The aerosol valve for high rate filling according to claim 10, wherein the spring is arranged at least partially inside of the switching valve.

14. The aerosol valve for high rate filling according to claim 1, wherein the switching valve is attached to the lower chamber.

15. The aerosol valve for high rate filling according to claim 1, wherein the narrow flow port in the switching valve is a hole formed in the switching valve.

16. The aerosol valve for high rate filling according to claim 1, wherein the pressing means are arranged in contact with the switching valve.

* * * * *